US009556746B2

(12) United States Patent
Paradis et al.

(10) Patent No.: US 9,556,746 B2
(45) Date of Patent: Jan. 31, 2017

(54) INTEGRATED STRUT AND TURBINE VANE NOZZLE ARRANGEMENT

(71) Applicant: Pratt & Whitney Canada Corp., Longueuil (CA)

(72) Inventors: Vincent Paradis, Longueuil (CA); Chris Pater, Longueuil (CA)

(73) Assignee: PRATT & WHITNEY CANADA CORP., Longueuil, QC (CA)

( * ) Notice: Subject to any disclaimer, the term of this patent is extended or adjusted under 35 U.S.C. 154(b) by 629 days.

(21) Appl. No.: 14/048,426

(22) Filed: Oct. 8, 2013

(65) Prior Publication Data

US 2015/0098812 A1 Apr. 9, 2015

(51) Int. Cl.

| | |
|---|---|
| ***F01D 9/04*** | (2006.01) |
| ***F01D 5/14*** | (2006.01) |
| ***F01D 5/30*** | (2006.01) |
| ***F01D 25/16*** | (2006.01) |
| ***F01D 25/24*** | (2006.01) |

(52) U.S. Cl.

CPC ..... *F01D 9/04* (2013.01); *F01D 5/142* (2013.01); *F01D 5/3007* (2013.01); *F01D 9/042* (2013.01); *F01D 25/162* (2013.01); *F01D 25/246* (2013.01)

(58) Field of Classification Search

CPC ..... F01D 9/04; F01D 9/041; F01D 9/042; F01D 9/065; F01D 5/142; F01D 5/3007; F01D 5/3015; F01D 5/326; F01D 25/162; F01D 25/246; F01D 9/044; F01D 9/02

USPC ..... 415/142, 192–195

See application file for complete search history.

(56) References Cited

U.S. PATENT DOCUMENTS

| | | | | |
|---|---|---|---|---|
| 3,617,147 | A | 11/1971 | Bragg | |
| 3,704,075 | A | 11/1972 | Karstensen et al. | |
| 3,745,629 | A | 7/1973 | Pask et al. | |
| 4,063,847 | A | 12/1977 | Simmons | |
| 4,478,551 | A | 10/1984 | Honeycutt, Jr. et al. | |
| 4,793,770 | A | 12/1988 | Schonewald et al. | |
| 4,989,406 | A * | 2/1991 | Vdoviak | F01D 25/162 244/117 A |
| 5,197,856 | A | 3/1993 | Koertge et al. | |
| 6,045,325 | A | 4/2000 | Horvath et al. | |
| 6,082,966 | A | 7/2000 | Hall et al. | |
| 6,439,838 | B1 | 8/2002 | Crall et al. | |
| 6,619,916 | B1 | 9/2003 | Capozzi et al. | |

(Continued)

FOREIGN PATENT DOCUMENTS

| | | |
|---|---|---|
| DE | 29715180 | 10/1997 |
| EP | 1510654 | 3/2005 |

(Continued)

OTHER PUBLICATIONS

European Search Report, Nov. 28, 2014.
Partial European Search Report, Apr. 22, 2014.
Extended European Search Report, Jan. 21, 2015.

*Primary Examiner* — Richard Edgar
*Assistant Examiner* — Jesse Prager
(74) *Attorney, Agent, or Firm* — Norton Rose Fulbright Canada LLP

(57) ABSTRACT

An integrated strut and turbine vane nozzle (ISV) arrangement according to an embodiment, includes a single-piece interturbine duct (ITD) and a plurality of vane nozzle segments removably attached to the ITD. Vane airfoils of the vane nozzle segments in combination with trailing edge portions of the struts, form a vane nozzle integrated with the ITD.

18 Claims, 5 Drawing Sheets

(56) References Cited

U.S. PATENT DOCUMENTS

| | | | | |
|---|---|---|---|---|
| 6,983,608 | B2 | 1/2006 | Allen, Jr. et al. | |
| 7,055,304 | B2 | 6/2006 | Courtot et al. | |
| 7,097,420 | B2 | 8/2006 | Cormier et al. | |
| 7,544,040 | B2 | 6/2009 | Marke et al. | |
| 7,549,839 | B2 | 6/2009 | Carroll et al. | |
| 7,553,129 | B2 | 6/2009 | Hoeger et al. | |
| 7,824,152 | B2 * | 11/2010 | Morrison | F04D 29/023 415/135 |
| 8,061,969 | B2 | 11/2011 | Durocher et al. | |
| 8,091,371 | B2 | 1/2012 | Durocher et al. | |
| 8,099,962 | B2 | 1/2012 | Durocher et al. | |
| 8,152,451 | B2 * | 4/2012 | Manteiga | F01D 9/02 415/115 |
| 8,177,488 | B2 * | 5/2012 | Manteiga | F01D 9/065 415/108 |
| 8,182,204 | B2 | 5/2012 | Durocher et al. | |
| 8,245,518 | B2 | 8/2012 | Durocher et al. | |
| 8,371,812 | B2 * | 2/2013 | Manteiga | F01D 9/02 415/115 |
| 2002/0071764 | A1 | 6/2002 | Turnquist et al. | |
| 2006/0024158 | A1 | 2/2006 | Hoeger et al. | |
| 2007/0092372 | A1 | 4/2007 | Carroll et al. | |
| 2009/0185899 | A1 | 7/2009 | Bouchard et al. | |
| 2009/0324400 | A1 | 12/2009 | Marini et al. | |
| 2010/0111690 | A1 | 5/2010 | Heriz Agiriano et al. | |
| 2010/0132371 | A1 | 6/2010 | Durocher et al. | |
| 2010/0132377 | A1 | 6/2010 | Durocher et al. | |
| 2010/0272566 | A1 | 10/2010 | Durocher et al. | |
| 2013/0084166 | A1 * | 4/2013 | Klingels | F01D 11/005 415/173.1 |
| 2013/0259672 | A1 | 10/2013 | Suciu et al. | |
| 2015/0044032 | A1 * | 2/2015 | Paradis | F01D 25/246 415/134 |
| 2015/0132054 | A1 * | 5/2015 | Dreischarf | F01D 25/24 403/376 |

FOREIGN PATENT DOCUMENTS

| | | | | |
|---|---|---|---|---|
| EP | 2206885 | A1 * | 7/2010 | F01D 5/326 |
| FR | 2980249 | | 3/2013 | |
| GB | 1058759 | | 2/1967 | |
| GB | 1534124 | | 11/1978 | |
| GB | 2226600 | | 7/1990 | |

* cited by examiner

INTEGRATED STRUT AND TURBINE VANE NOZZLE ARRANGEMENT

TECHNICAL FIELD

The application relates generally to gas turbine engines and, more particularly, to integrated strut and turbine vane nozzle arrangements in such engines.

BACKGROUND OF THE ART

Gas turbine engine ducts may have struts in the gas flow path, as well as vanes for guiding a gas flow through the duct. An integrated strut and turbine vane nozzle (ISV) forms a portion of a conventional turbine engine gas path. The ISV usually includes an outer and an inner ring connected together with struts which are airfoil-shaped in order to protect support structures and/or service lines in the inter turbine duct (ITD) portion, and airfoils/vanes in the turbine vane nozzle portion. The integration is achieved by combining the airfoil shaped strut with the airfoil shape of a corresponding one of the vanes. The ISV can be made from one integral piece or from an assembly of multiple pieces. However, it is more difficult to adjust the flow through the vane nozzle airfoil if the ISV is a single integral piece. A multiple-piece approach with segments of turbine vane nozzles allows the possibility of mixing different classes of segments in the ISV to achieve proper engine flow. However, a significant challenge in a multiple-piece arrangement of an ISV, is to minimize interface mismatch between the parts in order to reduce engine performance losses. Conventionally, complex manufacturing techniques are used to minimize this mismatch between the parts of the integrated strut and vane. In addition, mechanical joints such as bolts are conventionally used, but are problematic because of potential bolt seizing in the hot environment of the ISV.

SUMMARY

In one aspect, there is provided an integrated strut and turbine vane nozzle (ISV) arrangement for a gas turbine engine, comprising: an interturbine duct (ITD) including inner and outer annular duct walls arranged concentrically about an axis and defining an annular flow passage therebetween, an array of circumferentially spaced apart struts extending radially across the annular flow passage, each of the struts having an airfoil profile defining a leading edge and a trailing edge thereof, the inner and outer annual duct walls each defining a plurality of receivers in a respective downstream end section of the inner and outer annular duct walls, each of the receivers being circumferentially located between adjacent struts; and a plurality of vane nozzle segments, each of the vane nozzle segments including an inner ring segment, an outer ring segment and a plurality of spaced apart vane airfoils extending between and interconnecting the inner and outer ring segments, the vane nozzle segments being removably received in the respective receivers of the ITD, thereby forming in combination with the downstream end section of the inner and outer annular duct walls, a vane nozzle integrated with the ITD, the vane airfoils of the vane ring segments in combination with trailing edge portions of the respective struts forming an array of nozzle openings in a downstream end section of the annular flow passage.

In another aspect, there is provided an integrated strut and turbine vane nozzle (ISV) arrangement for a gas turbine engine, comprising: a single-piece interturbine duct (ITD) including inner and outer annular duct walls arranged concentrically about an axis and defining an annular flow passage therebetween, an array of circumferentially spaced apart struts extending radially across the annular flow passage, each of the struts having an airfoil profile defining a leading edge and a trailing edge thereof, the inner annular duct wall defining a plurality of slots in a downstream end section thereof, the outer annular duct wall defining a plurality of recesses in a downstream end section thereof, each of the slots and recesses defining two circumferentially spaced apart axial surfaces facing each other, each of the slots and recesses being circumferentially located between adjacent struts; a plurality of vane nozzle segments, each of the vane nozzle segments including an inner ring segment, an outer ring segment and a plurality of spaced apart vane airfoils extending between and interconnecting the inner and outer ring segments, each of the vane airfoils defining a leading edge and a trailing edge, the inner ring segments being removably received between the two axial surfaces of the respective slots of the inner annular duct wall, and the outer ring segment being removably received between the two axial surfaces of the respective recesses of the outer annular duct wall, thereby forming in combination with the downstream end section of the inner and outer annular duct walls, a vane nozzle integrated with the ITD, the vane airfoils of the vane ring segments in combination with trailing edge portions of the respective struts forming an array of nozzle openings in a downstream end section of the annular flow passage, the leading edges of the respective vane airfoils being disposed downstream of the leading edges of the respective struts, the training edges of the respective vane airfoils axially aligning with the trailing edges of the struts; and a retainer retaining the respective vane nozzle segments to the single-piece ITD.

In a further aspect, there is provided an integrated strut and turbine vane nozzle (ISV) arrangement for a gas turbine engine, comprising: a single-piece interturbine duct (ITD) including inner and outer annular duct walls arranged concentrically about an axis and defining an annular flow passage therebetween, an array of circumferentially spaced apart struts extending radially across the annular flow passage, each of the struts having an airfoil profile defining a leading edge and a trailing edge thereof, a plurality of pairs of vane airfoils radially extending between and interconnecting the inner and our annular duct walls, each of the struts being flanked by a pair of the vane airfoils, each of the vane airfoils defining a leading edge and a trailing edge thereof, the inner annular duct wall defining a plurality of slots in a downstream end section thereof, the outer annular duct wall defining a plurality of recesses in a downstream end section thereof, each of the slots and recesses defining two circumferentially spaced apart axial surfaces facing each other, each of the slots and recesses being circumferentially located between adjacent pairs of the vane airfoils; a plurality of vane nozzle segments, each of the vane nozzle segments including an inner ring segment, an outer ring segment and a plurality of spaced apart vane airfoils extending between and interconnecting the inner and outer ring segments, each of the vane airfoils defining a leading edge and a trailing edge, the inner ring segments being removably received between the two axial surfaces of the respective slots of the inner annular duct wall, and the outer ring segment being removably received between the two axial surfaces of the respective recesses of the outer annular duct wall, thereby forming in combination with the downstream end section of the inner and outer annular duct walls, a vane nozzle integrated with the ITD, the vane airfoils of the vane ring segments and the vane airfoils of the ITD in combination with trailing edge portions of the respective struts forming an array of nozzle openings in a downstream end section of the annular flow passage, the leading edges of the vane airfoils of the respective ITD and vane nozzle segments being disposed downstream of the leading edges of the respective struts in the annular flow passage, the training edges of the vane airfoils of the respective ITD and vane nozzle segments axially aligning with the trailing edges of the struts; and a retainer retaining the respective vane nozzle segments to the single-piece ITD.

DESCRIPTION OF THE DRAWINGS

Reference is now made to the accompanying figures in which.

It will be noted that throughout the appended drawings, like features will be identified by like reference numerals.

DETAILED DESCRIPTION

Figure 1:
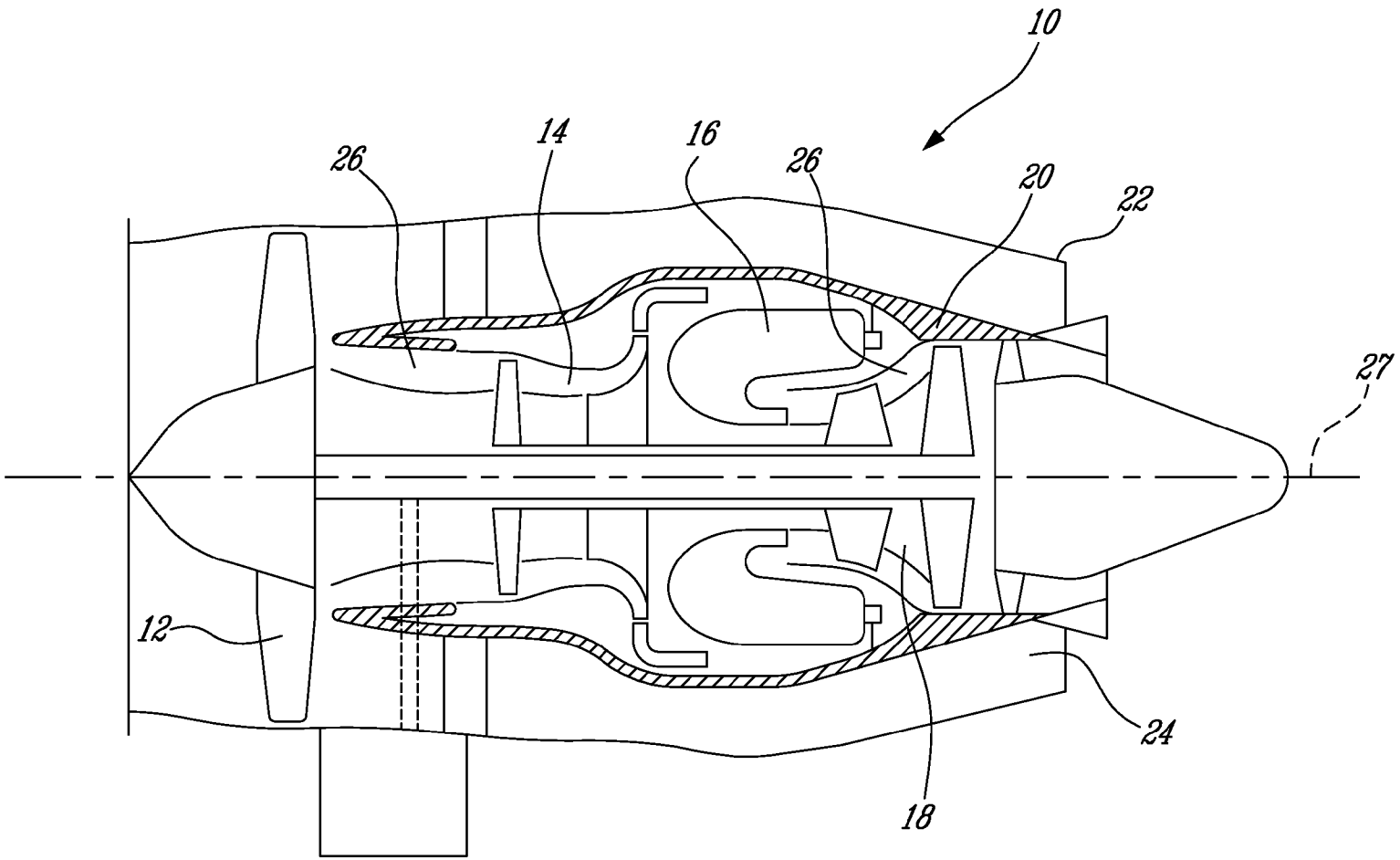
FIG. 1 is a schematic side cross-sectional view of a gas turbine engine.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

The turbine engine 10 includes a first casing 20 which encloses the turbo machinery of the engine and a second outer casing 22 extending outwardly of the first casing 20, thereby defining an annular bypass passage 24 therebetween. The air propelled by the fan 12 is split into a first portion which flows around the first casing 20 within the bypass passage 24, and a second portion which flows through a core flow path 26. The core flow path 26 is defined within the first casing 20 and allows the flow to circulate through the multistage compressor 14, the combustor 16 and the turbine section 18 as described above.

Throughout this description, the axial, radial and circumferential directions are respectively defined with respect to a central axis 27, and to the radius and circumference of the gas turbine engine 10. The terms "upstream" and "downstream" are defined with respect to the flow direction through the core flow path 26.

Figure 3:
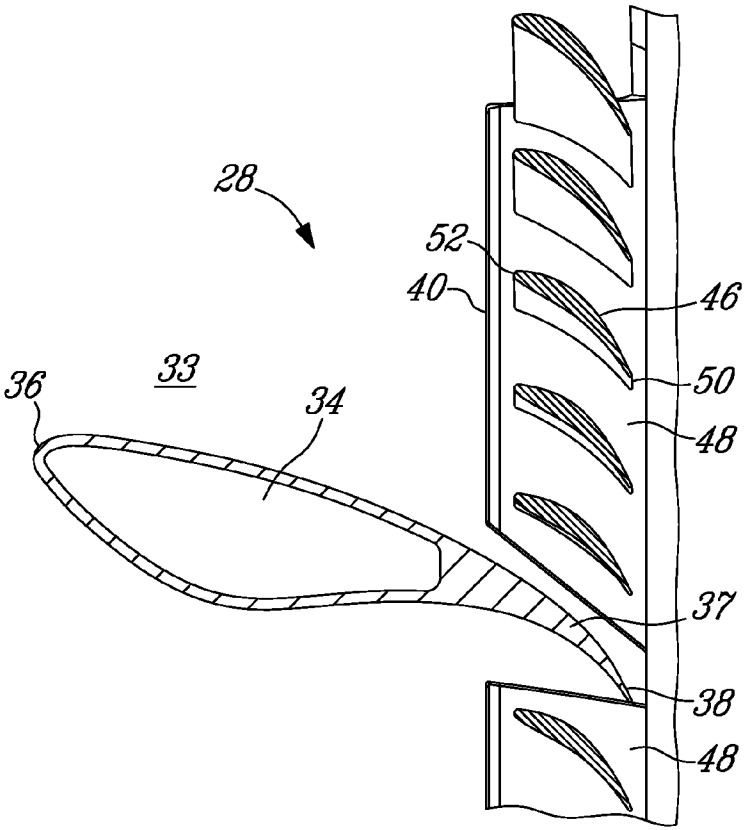
FIG. 3 is a cross-sectional view taken along line 3-3 in FIG. 2.
Figure 2:
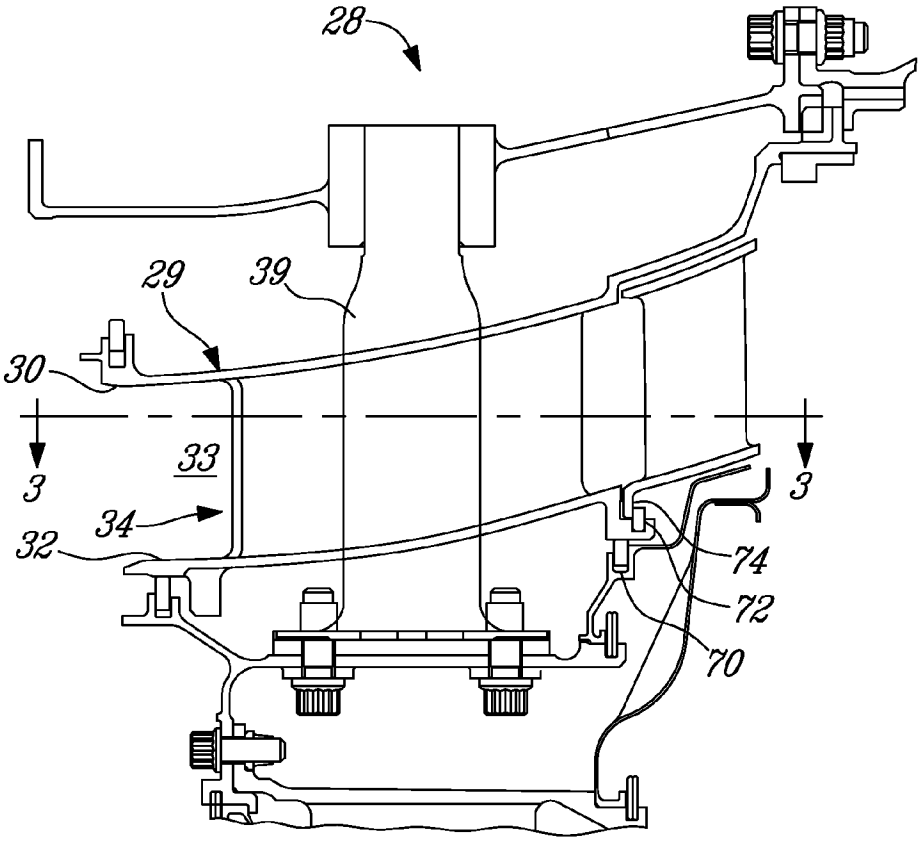
FIG. 2 is a cross-sectional view of an integrated strut and turbine vane nozzle (ISV) suitable for forming a portion of a turbine engine gas path of the engine shown in FIG. 1.

FIGS. 2-3 show an integrated strut and turbine vane nozzle (ISV) arrangement 28 suitable for forming a portion of the core flow path 26 of the engine 10 shown in FIG. 1. For instance, the ISV arrangement 28 may form part of a mid turbine frame system for directing a gas flow from a high pressure turbine assembly to a low pressure turbine assembly. However, it is understood that the ISV arrangement 28 may also be used in other sections of an engine.

It is also understood that the ISV arrangement 28 is not limited to turbofan applications. Indeed, the ISV arrangement 28 may be installed in other types of gas turbine engines such as turboprops, turboshafts and axial power units (APU).

The ISV arrangement 28 generally comprises a radially outer annular duct wall 30 and a radially inner annular duct wall 32 concentrically disposed about the engine central axis 27 (FIG. 1) and defines an annular flow passage 33 therebetween. The annular flow passage 33 defines an axial portion of the core flow path 26 (FIG. 1).

It can be appreciated that a plurality of circumferentially spaced apart struts 34 (only one shown in FIGS. 2 and 3) extend radially between and interconnect the outer and inner annular duct walls 30, 32 according to one embodiment. The struts 34 may have a hollow airfoil shape including a pressure side wall (not numbered) and a suction side wall (not numbered) defined between a leading edge 36 and a trailing edge 38 (FIG. 3) of the strut. Support structures 39 and service lines (not shown) may extend internally through the hollow struts 34. The struts 34 may be used to transfer loads and/or to protect a given structure (e.g. service lines) from high temperature gases flowing through the annular flow passage 33. Therefore, the outer and inner annular duct walls 30, 32 with the struts 34, generally form an interturbine duct (ITD) 29.

The array of circumferentially spaced apart struts 34 extends radially across the annular flow passage 33 with the trailing edge 38 thereof located downstream of the leading edge 36 thereof, within the annular flow passage 33, for example at a respective downstream end section (not numbered) of the inner and outer annular duct walls 32, 30.

The outer and inner annular duct walls 30, 32 and the struts 34 may form a single-piece component of the ITD 29.

Referring to FIGS. 2-6, a plurality of vane nozzle segments 40 are provided. Each vane nozzle segment 40 may be a single-piece component including a circumferential inner ring segment 42, a circumferential outer ring segment 44 and a plurality of circumferentially spaced apart vane airfoils 46 extending radially between and interconnecting the inner and outer ring segments 42, 44. The vane nozzle segments 40 may be removably attached to the ITD 29, and may be received, for example in respective receivers of the ITD 29 (which will be further described in detail hereinafter). Therefore, the vane nozzle segments 40 in combination with the downstream end section of the inner and outer annular duct walls 32, 30, form a vane nozzle (not numbered) of the ISV arrangement 28. The vane airfoils 46 of the vane nozzle segments 40 together with trailing edge portions 37 of the respective struts 34 form an array of nozzle openings 48 in a downstream end section of the annular flow passage 33.

A nozzle opening dimension measured circumferentially between trailing edges 50 of adjacent vane airfoils 46 may be substantially identical to a nozzle opening dimension measured circumferentially between the trailing edge 38 of each of the struts 34 and a trailing edge 50 of one of the vane airfoils 46 which is adjacent the strut 34. According to this embodiment, the vane airfoils 46 of the vane nozzle segments 40 may be axially positioned such that the trailing edges of the respective vane airfoils 46 axially align with the trailing edges 38 of the respective struts 34, while a leading edge 52 of the respective vane airfoils 46 is disposed in the annular flow passage 33 downstream of the leading edge 36 of the respective strut 34. Each inner ring segment 42 may include circumferentially opposed ends defining thereon, two end surfaces 54 facing away from each other. A lug member 56 projects circumferentially away from each of the end surfaces 54. Each circumferential outer ring segment 44 may include circumferentially opposed ends defining two end surfaces 58 facing away from each other, without projecting lugs members.

The receivers defined in the outer annular duct wall 30 may each be defined as a recess 60 in the downstream end section of the outer annular duct wall 30 (FIG. 4) including opposed axial surfaces 62 circumferentially facing each other. The receivers defined in the inner annular duct wall 32 may each be defined as a slot 64, including opposed axial surfaces 66 circumferentially facing each other. An axial groove 68 may be defined on each of the axial surfaces 66 for receiving axial insertion of the respective one of the lug members 56 when the inner ring segments 42 are removably received between the two axial surfaces 66 of the respective slots 64 and the outer ring segments 44 are removably received between the two axial surfaces 62 of the respective recesses 60 of the outer annular duct wall 30. The lug members 56 and the axial groove 68 in engagement, provide radial and circumferential retention of the vane nozzle segments 40 in position with respect to the ITD 29, as shown in FIG. 6.

Figure 4:
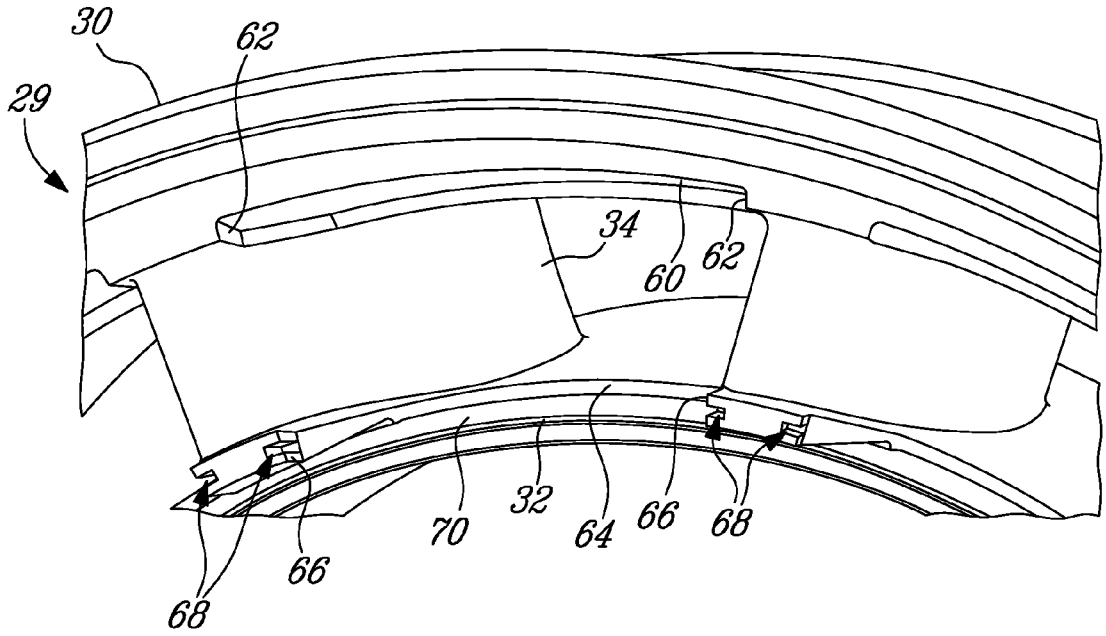
FIG. 4 is a partial isometric view of an inter turbine duct (ITD) in the ISV of FIG. 3 according to one embodiment.
Figure 5:
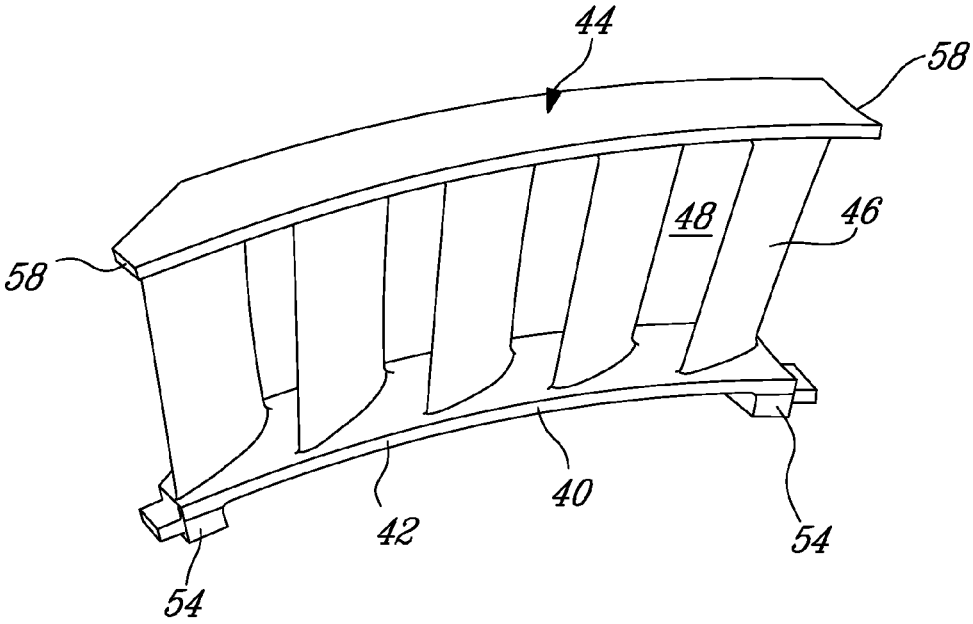
FIG. 5 is an isometric view of a vane nozzle segment for attachment to the ITD of FIG. 4.
Figure 6:
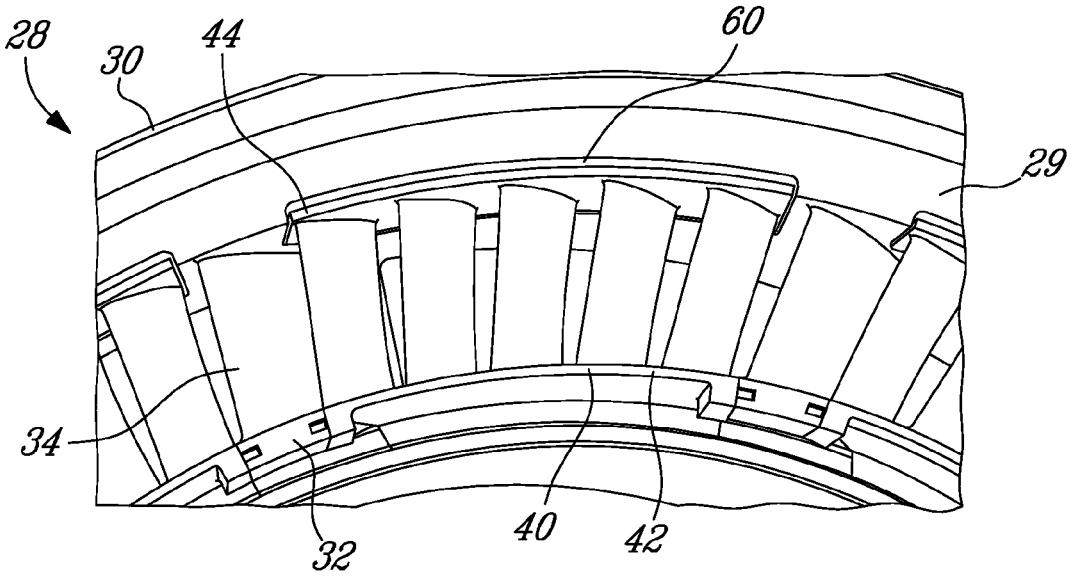
FIG. 6 is a partial isometric view of an integrated strut and turbine vane nozzle (ISV) including the ITD of FIG. 4 and the vane nozzle segments of FIG. 5.
Figure 7:
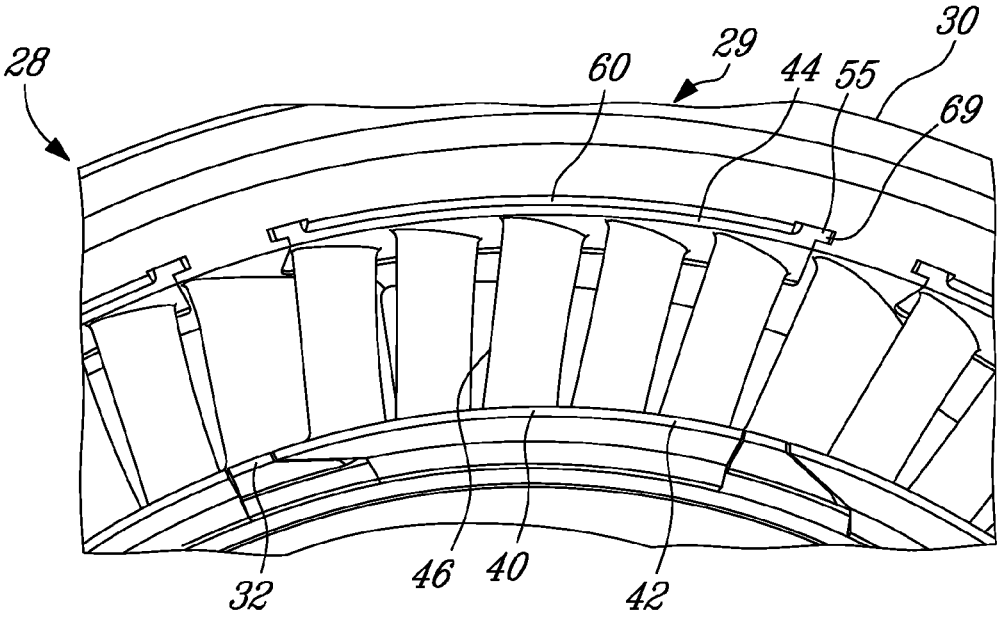
FIG. 7 is a partial isometric view of an ISV according to another embodiment.

According to another embodiment as shown in FIG. 7, the ITD 29 and the vane nozzle segments 40 are similar to the ITD 29 and the vane nozzle segments 40 shown in FIGS. 4-6 but the lug/groove engagement of the embodiment shown in FIG. 7 which is similar to the lug/groove engagement of the embodiment of FIGS. 4-6, is defined between the respective outer ring segments 44 and the outer annular duct wall 30 instead of between the respective inner ring segments 42 and the inner annular duct wall 32 as shown in FIG. 6. In particular, the inner ring segment 42 of the embodiment shown in FIG. 7, defines axial surfaces on two opposed ends thereof, facing away from each other, without lug members. The outer ring segment 44 of the vane nozzle segment 40 includes respective lug members 55, projecting away from axial surfaces (not numbered) which are defined on the opposed two ends of the outer ring segment 44, thereby facing away from each other. The lug members 55 may be axially inserted into axial grooves 69 defined in axial surfaces (not numbered) of the recess 60.

The ITD 29 may further define a circular or annular groove 70 (see FIGS. 2 and 4) in the inner annular duct wall 32 for releasably receiving a retaining ring 72, such as a split ring. The retaining ring 72 when received in the circumferential or annular groove 70 may be in contact with a circumferentially extending radial surface of the respective vane nozzle segments 40. For example, the circumferentially extending radial surface may be defined on a flange segment 74 projecting radially from the inner ring segment 42. Therefore, the retaining ring 72 releasably received circular or annular groove 70, axially retains the vane nozzle segments 40 in position with respect to the ITD 29.

In such a multiple-piece arrangement of the ISV 28, the combination of the airfoil shaped strut 34 with a corresponding vane airfoil is achieved by a single-piece strut component, thereby eliminating interface mismatch between the parts because there is no interface between the strut and the combined one of the vane airfoils which is a trailing edge portion, and part of the strut. Therefore, the interchange of the circumferential vane nozzle segments in the ISV to achieve proper engine flow will not result in any interface mismatch between the struts and the respective combined vane airfoils.

Figure 8:
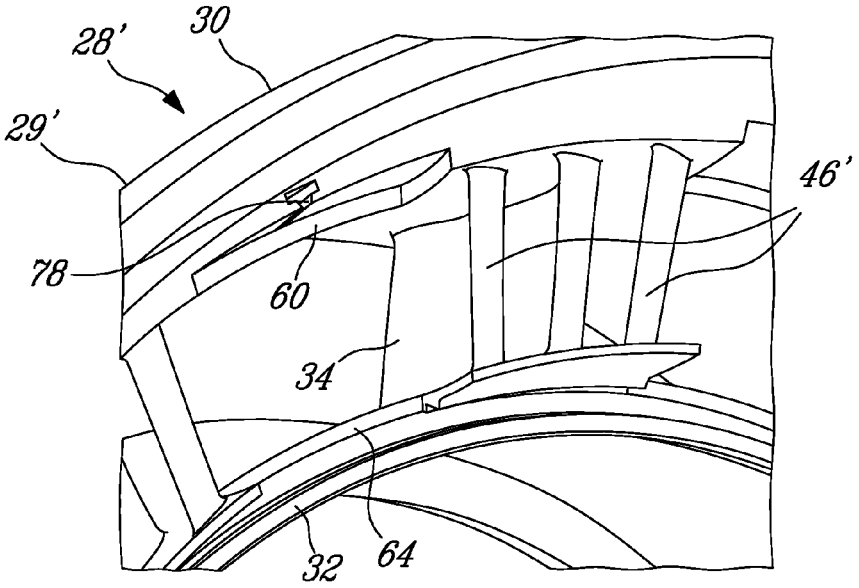
FIG. 8 is a partial isometric view of an ITD of the ISV of FIG. 3, according to a further embodiment.
Figure 9:
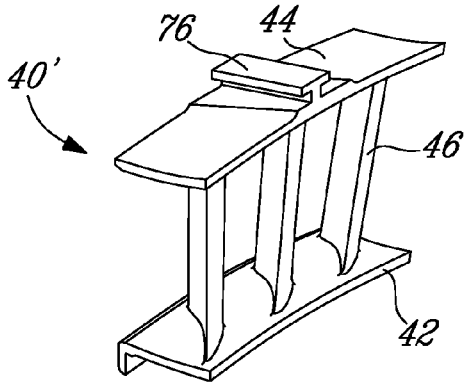
FIG. 9 is an isometric view of a vane nozzle segment for attachment to the ITD of FIG. 8.
Figure 10:
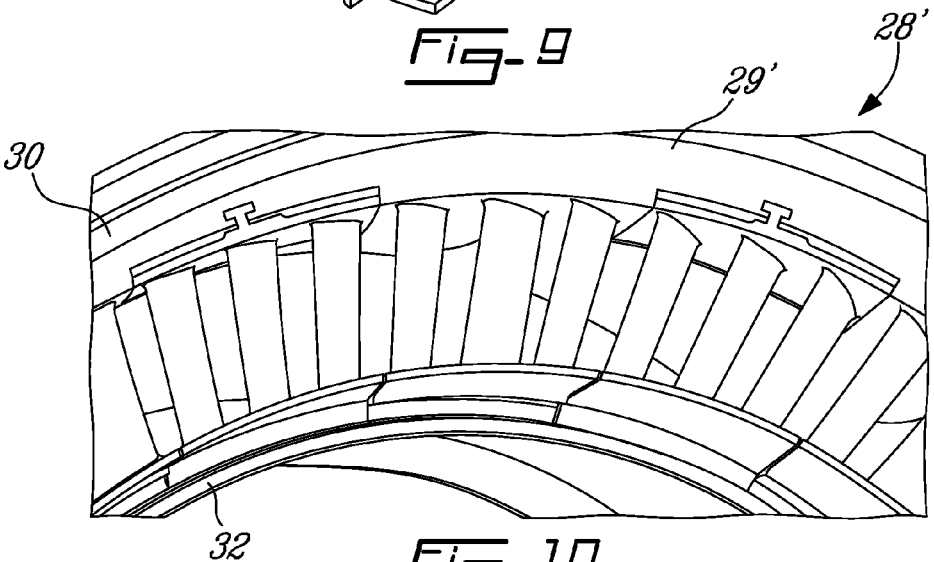
FIG. 10 is a partial isometric view of an ISV including the ITD of FIG. 8 and the vane nozzle segment as shown in FIG. 9.

FIGS. 8-10 illustrate another embodiment of the ISV arrangement 28' similar to the ISV arrangement 28 shown in FIGS. 2-7. The components and features of ISV arrangement 28' which are similar to those shown in FIGS. 2-7 are indicated by like numeral references and will not be described hereinafter. The description of the ISV 28' below will be focused on the differences between the ISV arrangement 28' and the ISV arrangement 28.

In the ISV arrangement 28' the single-piece ITD 29' may include not only the inner and outer annular duct walls 32, 30, and the struts 34, but also a plurality of vane airfoils 46' radially extending between and interconnecting the inner and outer annular duct walls 32, 30. The vane airfoils 46' of the ITD 29' (FIG. 8) are substantially identical in shape and size to the vane airfoils 46 of the vane nozzle segments 40' (FIG. 9). Similar to the vane nozzle segments 40 (FIG. 5), the vane nozzle segments 40' (FIG. 9) include circumferential inner and outer ring segments 42 and 44, interconnected by the vane airfoils 46. The trailing edges of the vane airfoils 46' of the ITD 29' may be axially aligned with the trailing edges of the struts 34, as well as with the trailing edges of the vane airfoils 46 of the vane nozzle segments 40' when the vane nozzle segments 40' are attached to the ITD 29', in a manner similar to that of the ISV arrangement 28 shown in FIGS. 2-7. It should be understood that the leading edge of the vane airfoils 46' of the ITD 29', may axially align with the leading edges of the vane airfoils 46 of the vane nozzle segments 40'.

According to this embodiment, each of the struts 34 of the ISV arrangement 28' is flanked by a pair of vane airfoils 46'. Also, each of the slots 64 defined in the inner annular duct wall 32 and each of the recesses 60 defined in the outer annular duct wall 30 are circumferentially located between adjacent pairs of the vane airfoils 46'. In this ISV arrangement 28' the vane nozzle segments 40' have fewer airfoils 46 than the vane nozzle segments 40 shown in FIGS. 2-7.

Alternative to the lug and groove engagement used in the ISV arrangement 28 of FIGS. 2-7, a T-shaped dovetail 76 may be provided on the outer ring segment 44, for example at a middle area of each of the vane nozzle segments 40'. The T-shaped dovetail 76 extending axially for axial insertion into an axial T-shaped groove 78 defined in the outer annular duct wall 30 of the ITD 29', for example in a central area of the bottom of each of the recesses 60.

The above description is meant to be exemplary only, and one skilled in the art will recognize that changes may be made to the embodiments described without departing from the scope of the described subject matter. It is also understood that various combinations of the features described above may be contemplated. For instance, the various types of lug-groove engagements are applicable alternatively to various embodiments. Various retaining devices which may be new or known to people skilled in the art may also be applicable to the described subject matter. Still other modifications which fall within the scope of the described subject matter will be apparent to those skilled in the art, in light of a review of this disclosure, and such modifications are intended to fall within the appended claims.

The invention claimed is:

1. An integrated strut and turbine vane nozzle (ISV) arrangement for a gas turbine engine, comprising:

an interturbine duct (ITD) including inner and outer annular duct walls arranged concentrically about an axis and defining an annular flow passage therebetween, an array of circumferentially spaced apart struts extending radially across the annular flow passage, each of the struts having an airfoil profile with a leading edge and a trailing edge portion, the inner and outer annular duct walls each defining a plurality of receivers in respective downstream end sections of the inner and outer annular duct walls, each of the receivers being circumferentially located between adjacent struts, each of the receivers including a pair of opposed axial surfaces circumferentially facing each other, the receivers in the inner or outer duct wall further including at least one axially extending slot;

a plurality of vane nozzle segments, each of the vane nozzle segments including an inner ring segment, an outer ring segment and a plurality of spaced apart vane airfoils extending between and interconnecting the inner and outer ring segments, the vane nozzle segments being removably received in the respective receivers of the ITD between the opposed axial surfaces of the receivers, the inner or outer ring segment of each of the vane nozzle segments having at least one lug slidably axially engaged in the at least one axially extending slot of an associated one of the receivers, the vane nozzle segments cooperating with the downstream end section of the inner and outer annular duct walls to provide a vane nozzle integrated with the ITD, the vane airfoils of the vane ring segments in combination with trailing edge portions of the respective struts forming an array of nozzle openings in a downstream end section of the annular flow passage, and a retaining ring mounted in a circumferential groove defined in the inner or outer annular duct wall of the ITD, the retaining ring axially retaining the vane nozzle segments in the receivers.

2. The integrated strut and turbine vane nozzle (ISV) arrangement as defined in claim 1 wherein the vane airfoils of the vane nozzle segments are axially positioned such that trailing edges of the respective vane airfoils axially align with the trailing edges of the respective struts.

3. The integrated strut and turbine vane nozzle (ISV) arrangement as defined in claim 1 wherein a nozzle opening dimension measured circumferentially between trailing edges of adjacent vane airfoils is substantially identical to a nozzle opening dimension measured circumferentially between the trailing edge of each of the struts and a trailing edge of one of the vane airfoils which is adjacent the strut.

4. The integrated strut and turbine vane nozzle (ISV) arrangement as defined in claim 1 wherein the at least one axially extending slot comprises a plurality of slots defined in a number of the receivers, the slots receiving the at least one lug of the respective vane nozzle segments to radially and circumferentially retain the respective vane nozzle segment in position such that the inner ring segments and the outer ring segments form part of the respective inner and outer annular duct walls of the ITD.

5. The integrated strut and turbine vane nozzle (ISV) arrangement as defined in claim 4 wherein the at least one lug is disposed on each of the outer ring segments and wherein the slots are defined in the outer annular duct wall, and wherein the at least one lug includes a pair of lugs projecting outwardly from opposed circumferential ends of each outer ring segments.

6. The integrated strut and turbine vane nozzle (ISV) arrangement as defined in claim 4 wherein the at least one lug is disposed on each of the inner ring segments and wherein the slots are defined in the inner annular duct wall.

7. The integrated strut and turbine vane nozzle (ISV) arrangement as defined in claim 1 wherein the inner ring segments each comprise circumferentially opposed ends defining two end surfaces facing away from each other, the at least one lug comprising opposed lugs projecting circumferentially away from each of the end surfaces, and wherein the axially extending slot comprises a pair of axial slots defined on the opposed axial surfaces of each receiver in the inner annular duct wall for receiving axial insertion of the respective one of the lugs to thereby radially and circumferentially retain the vane nozzle segments in position with respect to the ITD.

8. The integrated strut and turbine vane nozzle (ISV) arrangement as defined in claim 1 wherein the outer ring segments each comprise circumferentially opposed ends defining two end surfaces facing away from each other, the at least one lug comprising lugs projecting circumferentially away from each of the end surfaces, and wherein the at least one axially extending slot comprises an axial slot defined on each of the opposed axial surfaces of the receivers in the outer annular duct wall for receiving axial insertion of the respective one of the lugs to thereby radially and circumferentially retain the vane nozzle segments in position with respect to the ITD.

9. The integrated strut and turbine vane nozzle (ISV) arrangement as defined in claim 1 wherein the retaining ring is in contact with a circumferentially extending radial surface of the respective vane nozzle segments to thereby axially retain the vane nozzle segments in position with respect to the ITD.

10. The integrated strut and turbine vane nozzle (ISV) arrangement as defined in claim 9 wherein the circumferential groove is defined in the inner annular duct wall.

11. The integrated strut and turbine vane nozzle (ISV) arrangement as defined in claim 9 wherein each of the vane nozzle segments comprises a flange segment projecting radially away from the inner ring segment, the flange segment defining said circumferentially extending radial surface.

12. The integrated strut and turbine vane nozzle (ISV) arrangement as defined in claim 1 wherein the ITD is a single-piece component which includes said inner and outer annular duct walls, said struts and a plurality of vane airfoils radially extending between and interconnecting the inner and outer annular duct walls, the vane airfoils of the ITD being identical to the vane airfoils of the vane nozzle segments in shape and size, trailing edges of the vane airfoils of the ITD axially aligning with the trailing edges of the struts.

13. The integrated strut and turbine vane nozzle (ISV) arrangement as defined in claim 12 wherein said vane airfoils of the ITD are arranged in pairs, each of the struts being flanked by a pair of the vane airfoils of the ITD.

14. The integrated strut and turbine vane nozzle (ISV) arrangement as defined in claim 1 wherein a leading edge of the respective vane airfoils is disposed downstream of the leading edge of the respective struts in the annular flow passage.

15. The integrated strut and turbine vane nozzle (ISV) arrangement as defined in claim 1 wherein the receivers are defined as a plurality of recesses in the outer annular duct wall and a plurality of slots in the inner annular duct wall.

16. The integrated strut and turbine vane nozzle (ISV) arrangement as defined in claim 1 wherein each of the vane nozzle segments comprises a T shaped dovetail configuration on the outer ring segment and wherein the ITD comprises a T shaped groove for receiving axial insertion of the T shaped dovetail configuration.

17. An integrated strut and turbine vane nozzle (ISV) arrangement for a gas turbine engine, comprising:

a single-piece interturbine duct (ITD) including inner and outer annular duct walls arranged concentrically about an axis and defining an annular flow passage therebetween, an array of circumferentially spaced apart struts extending radially across the annular flow passage, each of the struts having an airfoil profile defining a leading edge and a trailing edge thereof, the inner annular duct wall defining a plurality of slots in a downstream end section thereof, the outer annular duct wall defining a plurality of recesses in a downstream end section thereof, each of the slots and recesses defining two circumferentially spaced apart axial surfaces facing each other, each of the slots and recesses being circumferentially located between adjacent struts;

a plurality of vane nozzle segments, each of the vane nozzle segments including an inner ring segment, an outer ring segment and a plurality of spaced apart vane airfoils extending between and interconnecting the inner and outer ring segments, each of the vane airfoils defining a leading edge and a trailing edge, the inner ring segments being axially removably received between the two axial surfaces of the respective slots of the inner annular duct wall, and the outer ring segment being axially removably received between the two axial surfaces of the respective recesses of the outer annular duct wall, thereby forming in combination with the downstream end section of the inner and outer annular duct walls, a vane nozzle integrated with the ITD, the vane airfoils of the vane ring segments in combination with trailing edge portions of the respective struts forming an array of nozzle openings in a downstream end section of the annular flow passage, the leading edges of the respective vane airfoils being disposed downstream of the leading edges of the respective struts, the trailing edges of the respective vane airfoils axially aligning with the trailing edges of the struts, wherein each of the vane nozzle segments has at least one lug axially engaged in a corresponding axial groove defined in the slots, the engagement of the at least one lug with the corresponding axial groove radially and circumferentially retaining the vane nozzle segments in position with respect to the ITD; and a retaining ring received in a circumferential groove defined in the ITD, the retaining ring axially retaining the respective vane nozzle segments into the slots and recesses in the inner annular duct wall and the outer annular duct wall of the ITD.

18. An integrated strut and turbine vane nozzle (ISV) arrangement for a gas turbine engine, comprising:

a single-piece interturbine duct (ITD) including inner and outer annular duct walls arranged concentrically about an axis and defining an annular flow passage therebetween, an array of circumferentially spaced apart struts extending radially across the annular flow passage, each of the struts having an airfoil profile defining a leading edge and a trailing edge thereof, a plurality of pairs of vane airfoils radially extending between and interconnecting the inner and outer annular duct walls, each of the struts being flanked by a pair of the vane airfoils, each of the vane airfoils defining a leading edge and a trailing edge thereof, the inner annular duct wall defining a plurality of slots in a downstream end section thereof, the outer annular duct wall defining a plurality of recesses in a downstream end section thereof, each of the slots and recesses defining two circumferentially spaced apart axial surfaces facing each other, each of the slots and recesses being circumferentially located between adjacent pairs of the vane airfoils;

a plurality of vane nozzle segments, each of the vane nozzle segments including an inner ring segment, an outer ring segment and a plurality of spaced apart vane airfoils extending between and interconnecting the inner and outer ring segments, each of the vane airfoils defining a leading edge and a trailing edge, the inner ring segments being removably received between the two axial surfaces of the respective slots of the inner annular duct wall, and the outer ring segment being removably received between the two axial surfaces of the respective recesses of the outer annular duct wall, thereby forming in combination with the downstream end section of the inner and outer annular duct walls, a vane nozzle integrated with the ITD, the vane airfoils of the vane ring segments and the vane airfoils of the ITD in combination with trailing edge portions of the respective struts forming an array of nozzle openings in a downstream end section of the annular flow passage, the trailing edges of the vane airfoils of the respective ITD and vane nozzle segments axially aligning with the trailing edges of the struts, wherein each of the vane nozzle segments has at least one lug axially engaged in a corresponding axial groove defined in the slots, the engagement of the at least one lug with the corresponding axial groove radially and circumferentially retaining the vane nozzle segments in a position with respect to the ITD; and a retaining ring received in a circumferential groove defined in the ITD, the retaining ring axially retaining the respective vane nozzle segments to the single-piece ITD.

* * * * *